United States Patent [19]

Lostoski

[11] Patent Number: 5,010,959

[45] Date of Patent: Apr. 30, 1991

[54] AUTOMATIC SPRINKLER HEAD

[75] Inventor: Douglas A. Lostoski, Richfield, Ohio

[73] Assignee: Automatic Sprinkler Corporation of America, Cleveland, Ohio

[21] Appl. No.: 447,045

[22] Filed: Dec. 7, 1989

[51] Int. Cl.[5] ..... A62C 37/08

[52] U.S. Cl. ..... 169/37; 169/90

[58] Field of Search ..... 169/19, 37, 90

[56] References Cited

U.S. PATENT DOCUMENTS

| | | | |
|---|---|---|---|
| 1,996,077 | 4/1935 | Loepsinger . | |
| 2,519,704 | 8/1950 | Rowley . | |
| 2,528,063 | 10/1950 | Loepsinger . | |
| 2,768,696 | 10/1956 | Sherburne . | |
| 3,223,171 | 12/1965 | DeGroot et al. | 169/37 |
| 4,108,247 | 8/1978 | Mohler . | |
| 4,167,974 | 9/1979 | Job . | |
| 4,830,115 | 5/1989 | Polan | 169/90 |

FOREIGN PATENT DOCUMENTS

| | | | |
|---|---|---|---|
| 3225798 | 1/1984 | Fed. Rep. of Germany | 169/37 |

*Primary Examiner*—Sherman D. Basinger
*Assistant Examiner*—Stephen P. Avila
*Attorney, Agent, or Firm*—Jones, Day, Reavis & Pogue

[57] ABSTRACT

An automatic sprinkler head comprising a body with a passageway for fire-extinguishing fluid, a frame extending from the body having a deflector plate opposite the passageway, a closure assembly (including a closure thimble) for closing the passageway, a thermally responsive glass bulb interposed between the closure assembly and the deflector plate, and a means to minimize lodgement of the closure assembly. The means to minimize lodgement of the closure assembly is interposed between the glass bulb and the closure thimble. The means to minimize lodgement is preferably an underground spiral spring and causes the closure assembly and any glass bulb fragments to tumble away from the axis of the passageway when the glass bulb fractures, thus minimizing the possibility of the closure assembly and glass bulb fragments becoming lodged against the deflector plate.

5 Claims, 1 Drawing Sheet

AUTOMATIC SPRINKLER HEAD

FIELD OF INVENTION

This invention relates to automatic sprinkler heads. More particularly, it pertains to an automatic sprinkler head comprising a body with a passageway, a glass bulb trigger element, a closure assembly comprised of a closure thimble or cup, and a means interposed between the closure thimble and the glass bulb which minimizes lodgment of the closure assembly and/or fragments of the glass bulb upon triggering.

BACKGROUND

Automatic sprinkler heads generally have a body with a passageway for a fire extinguishing fluid, such as water, which is sealed off by a closure assembly. The closure assembly is sometimes referred to as a "valve" or "valve assembly." Opposite the passageway, a deflector plate is typically affixed to a frame extending from the body of the sprinkler head. Between the closure assembly and the deflector plate, there usually is placed a heat-sensitive trigger element, such as a fluid-filled glass bulb or a heat-fused soldered link. At normal room temperatures, the trigger element maintains the closure assembly closed. The trigger element is designed to break, fracture or disintegrate, at selected elevated temperatures. When the trigger element breaks, the external pressure which keeps the closure assembly closed is removed, and the pressure of the water in the sprinkler head supply line normally forces the closure assembly, any mounting and holding means for the trigger element, and any components or fragments of the trigger element clear of the region between the passageway and the deflector plate.

When the closure assembly is forced open upon triggering, a problem may arise if the closure assembly or a portion of the trigger element becomes lodged against the deflector plate and/or sprinkler frame by the water rushing out of the passageway. Any lodgement can impair the flow of water from the sprinkler head, thereby reducing the fire-extinguishing capability of the sprinkler system.

SUMMARY OF INVENTION

An object of the present invention is to minimize lodgement of the closure assembly and/or any fragments of a glass bulb trigger element of an automatic sprinkler head. This object is achieved through the use of a means to minimize lodgement—preferably an unground spiral spring—which, when placed between the trigger element and the closure thimble, causes the closure assembly and any fragments of the glass bulb to tumble away from the axis of the passageway upon triggering. The lateral or rotational movement of the closure assembly and glass bulb fragments, in addition to the movement in the direction of the deflector plate, helps to prevent their lodgement against the deflector plate and frame.

BRIEF DESCRIPTION OF THE DRAWINGS

The invention is explained in more detail below with reference to the drawings, in which.

DESCRIPTION OF PREFERRED EMBODIMENT

Figure 1:
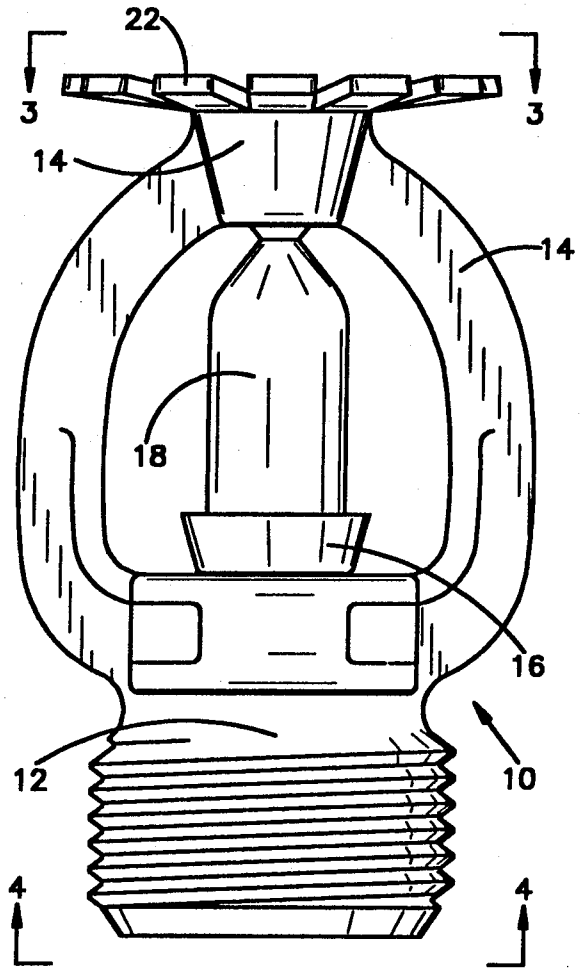
FIG. 1 is an elevational view of an automatic sprinkler head according to this invention.

The automatic sprinkler head 10 in FIG. 1 comprises a sprinkler body 12 from which a frame 14 extends. The body 12 is exteriorly threaded for engagement with a supply line carrying fire-extinguishing fluid (typically water) under pressure. A closure assembly closes off the passageway 26 for fire-extinguishing fluid. The closure assembly is comprised of a closure thimble 16 and a Belleville spring or washer 24. The closure assembly is held closed by a conventional, thermally responsive glass bulb or trigger 18, which is interposed between the closure thimble 16 on the one end, and the tip 20 of a pintle screw 32 on the other end. Opposite the sprinkler body 12, a deflector plate 22 is affixed to the frame 14.

Figure 3:
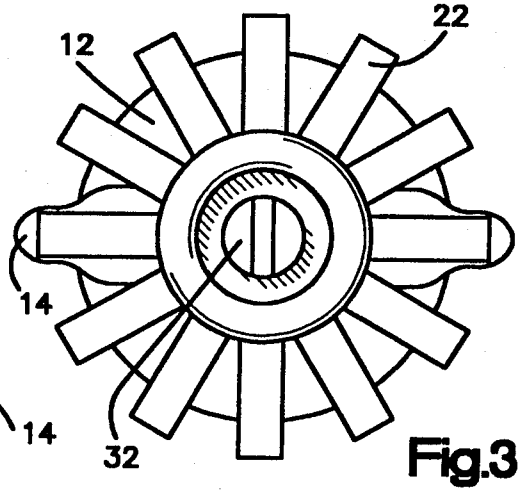
FIG. 3 is a plan view looking downward at the automatic sprinkler head shown in FIG. 1 as indicated by line 3—3.
Figure 4:
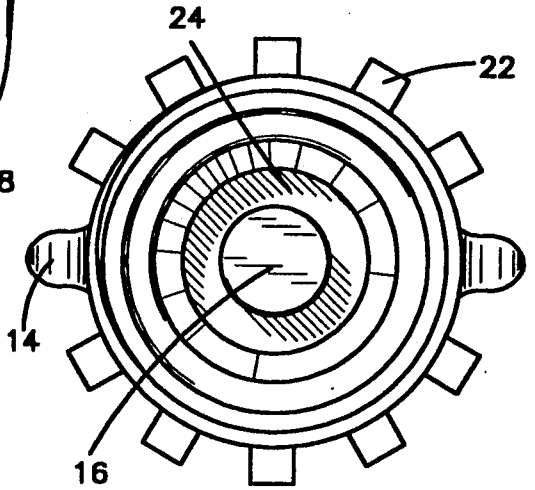
FIG. 4 is a bottom view looking upward on the automatic sprinkler head shown in FIG. 1 along line 4—4.
Figure 2:
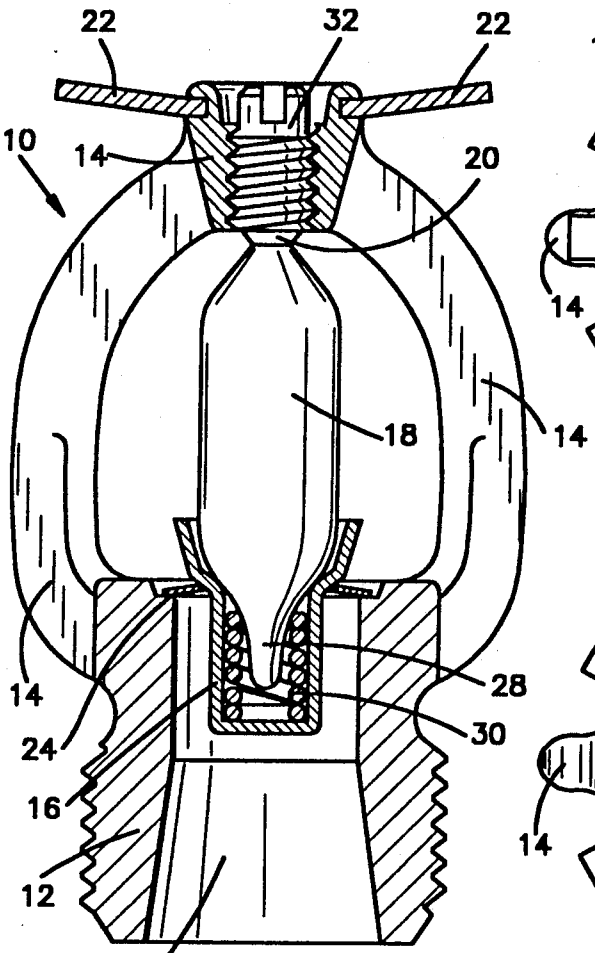
FIG. 2 is a longitudinal section through the automatic sprinkler head shown in FIG. 1.

As shown in FIG. 2, the closure assembly is comprised of a Belleville spring 24 and the closure thimble 16, which partially extends into the passageway 26 of the sprinkler head 10. The closure thimble 16 encloses the capillary end 28 of the glass bulb 18. The Belleville spring 24 helps provide resiliency to the closure assembly and glass bulb components so that normal changes in temperature, humidity and so forth do not alter the force which is exerted on the glass bulb 18. Furthermore, the Belleville spring 24 is useful in helping to tighten the seal of the closure assembly over the passageway 26. The Belleville spring 24 may be wrapped in Teflon tape to help to make the closure assembly watertight when closed. Preferably, the closure thimble comprises a flared outer flange and a cylindrical portion, which houses a spring 30.

An unground spiral spring 30 is interposed between the glass bulb 18 and the closure thimble 16. Specifically, the spiral spring 30 is interposed between the bottom of the closure thimble 16 and the glass bulb 18, while the top of the closure thimble 16 extends out of the passageway 26. Thus, the glass bulb 18 is lodged against the tip 20 of the pintle screw 32 on one end, and against the closure thimble 16 and spiral spring 30 on the other end. The axis of the passageway extends from the tip 20 of the pintle screw 32, through the glass bulb 18, and down through the middle of the passageway 26. The capillary end 28 of the glass bulb 18 extends into the hollow of the spiral spring 30. Both are enclosed by the cylindrical portion of the closure thimble 16. The spiral spring 30 is compressed when the sprinkler head is in the closed position.

The glass bulb 18 is designed to break or fracture at a predetermined temperature. Upon breaking of the glass bulb 18, the closing force exerted on the closure assembly is released, and the water pressure in the supply line forces the Belleville spring 24 and closure thimble 16 out of the passageway 26. At the same time, the spiral spring 30 extends or expands and causes some lateral movement of the closure thimble 16 and Belleville spring 24, thereby urging the closure assembly and any glass bulb fragments to tumble away from the axis of the passageway 26 clear of the pintle screw 32, deflector plate 22 and frame 14. This minimizes the chance for the closure assembly or any fragments of the glass bulb 18 from becoming lodged against the deflector plate 22, frame 14 or tip 20 of the pintle screw 32, where they could obstruct the flow of fire-extinguishing fluid.

An unground spiral spring is the preferred means to minimize lodgement, but a flat-ground spiral spring also minimizes the chance of lodgement of the closure assembly and glass bulb fragments. Other resilient means may be conceived which would be capable of causing the closure assembly and glass bulb fragments to tumble away from the axis of the passageway in a manner which minimizes or reduces lodgement. Without being bound by the following theories, it is believed that the resilient means is able to minimize lodgement either by exerting a component force on the closure thimble and glass bulb in a direction lateral to the axis of the passageway, or, alternatively, by exerting a force on the closure thimble and glass bulb which is not evenly balanced along the axis of the passageway.

The closure thimble of the valve assembly should be shaped so that it will enclose the capillary end of the glass bulb, and, hence, may be described as a thimble or cup. In the preferred embodiment described herein, the capillary end of the glass bulb does not itself rest against the spiral spring in the closure thimble. Rather, the spiral spring and closure thimble rest against the glass bulb at the point where the glass bulb begins to taper into the capillary end.

What is claimed is:

1. An automatic sprinkler head having:

a body with a passageway for fire-extinguishing fluid;

a frame extending from said body having a deflector plate opposite said passageway;

a closure assembly for closing said passageway, said closure assembly including a closure thimble;

a glass bulb interposed between said closure assembly and said deflector plate to hold said closure assembly closed, said glass bulb having a capillary end which is enclosed by the closure thimble, and said glass bulb being thermally responsive so as to fracture at a predetermined temperature into fragments and release said closure assembly; and means to minimize lodgement of said closure assembly and fragments of said glass bulb, said means being at least partially enclosed by the closure thimble and being interposed between the closure thimble and the glass bulb such that one end of said means is lodged against the end of the glass bulb having the capillary end and the other end of said means is lodged against the closure thimble, and said means causing the closure assembly and fragments of the glass bulb to tumble away from the axis of the passageway when the glass bulb fractures.

2. An automatic sprinkler head in accordance with claim 1 in which the means to minimize lodgement is an unground spiral spring.

3. An automatic sprinkler head in accordance with claim 1 in which the means to minimize lodgement is a flat-ground spiral spring.

4. An automatic sprinkler head in accordance with claim 2 in which the capillary end of the glass bulb extends into the hollow of the unground spiral spring, said unground spiral spring being enclosed by the closure thimble.

5. An automatic sprinkler head in accordance with claim 3 in which the capillary end of the glass bulb extends into the hollow of the flat-ground spiral spring, said flat-ground spiral spring being enclosed by the closure thimble.

* * * * *